US006095523A

United States Patent [19]

Lampman

[11] Patent Number: 6,095,523

[45] Date of Patent: Aug. 1, 2000

[54] METHOD OF PLAYING MODIFIED CHESS GAME

[76] Inventor: Michael Alan Lampman, 9301 110$^{th}$ St. SW., Lakewood, Wash. 98498

[21] Appl. No.: 09/236,486

[22] Filed: Jan. 25, 1999

[51] Int. Cl.$^{7}$ ..... A63F 3/02

[52] U.S. Cl. ..... 273/260; 273/261; 273/262

[58] Field of Search ..... 273/260, 261, 273/262, 236, 242, 287

[56] References Cited

U.S. PATENT DOCUMENTS

| | | |
|---|---|---|
| 3,652,091 | 3/1972 | Zubrin . |
| 4,015,849 | 4/1977 | MacLean . |
| 4,147,360 | 4/1979 | Baily . |
| 4,211,420 | 7/1980 | Quiroz . |
| 4,300,768 | 11/1981 | Weshsler . |
| 4,552,364 | 11/1985 | Shaffer . |
| 4,778,187 | 10/1988 | Deak . |
| 5,125,666 | 6/1992 | Adams . |
| 5,257,787 | 11/1993 | Miccio . |
| 5,421,582 | 6/1995 | Ritter . |
| 5,492,332 | 2/1996 | Hessnice . |
| 5,511,793 | 4/1996 | Watt . |
| 5,642,885 | 7/1997 | Gustin . |
| 5,662,329 | 9/1997 | Nason . |
| 5,690,334 | 11/1997 | Duke . |
| 5,735,523 | 4/1998 | Fioriglio . |

*Primary Examiner*—Sebastiano Passaniti
*Assistant Examiner*—V K Mendiratta
*Attorney, Agent, or Firm*—David S. Thompson

[57] ABSTRACT

A method of playing a modified chess game provides a game board having alternating dark and light squares arrayed in a ten-row by ten-column configuration. The sixteen pieces of orthodox chess are all provided in each color, with the addition of ninth and tenth pawns and two new "dragon" pieces. Four dragon's lair squares are provided, two on each of the first and tenth rows. The dragon's lair squares provide a starting location for each dragon, and are located adjacent to starting position of the king and queen. A king may not move into the dragon's lair square of the opposing team; therefore a king caught between these squares may be checkmated by the opposing king with the assistance of only two knights.

3 Claims, 4 Drawing Sheets

METHOD OF PLAYING MODIFIED CHESS GAME

BACKGROUND

A large number of board games are known, with chess being one of several of the oldest known games that is still high in popularity. Not surprisingly, there have been a number of attempts to improve upon the game of chess.

U.S. Pat. No. 5,735,523, issued to Patrick D. C. Floriglio in 1998 is one example of a chess improvement having a board that is eight spaces deep and ten spaces wide. Two new pieces, "earls," are introduced, each originally lined up between the bishop and knight prior to play. Each earl is moved two spaces in a first diagonal direction, and then one space in a second diagonal direction.

U.S. Pat. No. 5,690,334, issued to George William Duke in 1997 discloses a similar eight by ten board with two new "falcon" pieces. While the falcon pieces cannot jump over other pieces, in other manners tend to exhibit considerable freedom of movement.

Other U.S. Pat. Nos., such as 5,421,582, 4,778,187 and 3,652,091 are introduce still further variations, such as facilities enabling the participation of third and fourth players.

Unfortunately, while much innovation has been directed to chess improvements, few of these games have gained considerable acclaim or popularity. What is needed is a still further chess improvement, which introduces a new piece and a new board layout which enhances and improves the game of chess for new and experienced players alike.

SUMMARY

The present invention is directed to a method of play which provides an improved chess game, and includes the steps of:

(A) Providing a game board consisting of ten horizontal rows and ten vertical columns of squares having alternating light and dark colors.

(B) Defining dragon lair spaces on the first row at the fourth and seventh spaces and on the tenth row on the fourth and seventh spaces, and providing indicia by which the dragon lair spaces may be distinguished from other spaces.

(C) Providing a plurality of playing pieces, including one set of light-colored pieces for the first player a second set of dark-colored pieces for the second player, each set of pieces including ten pawns, one king, one queen, two rooks, two bishops, two knights, and two dragons, wherein the dragons are visually distinguishable from the other pieces.

(D) Initially positioning the set of light-colored pieces, at the start of the game, in the first row of ten squares at a first end of the game board from left to right in the sequence, rook, knight, bishop, dragon, queen, king, dragon, bishop, knight, and rook, with the light-colored pawns being initially positioned, one pawn in each square of the second row of ten squares.

(E) Initially positioning the set of dark-colored pieces in the tenth row of ten squares at the opposing end of the game board, from left to right in the sequence rook, knight, bishop, dragon, queen, king, dragon, bishop, knight, rook, with the dark-colored pawns being initially positioned, one pawn in each square of the ninth row of ten squares.

(G) Formatting rules of movement for play wherein each of the queens, the rooks, the bishops, and the knights have the same rule of movement as the corresponding pieces in orthodox chess.

(H) Formatting rules of movement for play wherein each of the pawns have the same rule of movement as the corresponding piece in orthodox chess, except that each pawn, on its first move, may move forwardly one, two or three squares.

(I) Formatting rules of movement for play wherein each of the kings have the same rule of movement as the corresponding piece in orthodox chess, except that a king initially starting on the first row may not move onto the dragon spaces of the tenth row, and that a king initially starting on the tenth row may not move onto the dragon spaces of the first row. As a result of this restriction, a first king may be checkmated by a second king and two knights of the second king's color. For example, a checkmate may take place by trapping the king originally starting on the first row between the dragon spaces on the tenth row.

(J) Formatting rules of movement for play wherein each of the dragons may move in the following manner:

(a) Three squares in either horizontal or either vertical direction.

(b) Three squares in either horizontal direction and two squares in either vertical direction.

(L) Three squares in either vertical direction and two squares in either horizontal direction.

It is therefore a primary advantage of the present invention to provide a novel method of playing a modified chess game with a novel piece, the dragon, providing new and interesting moves, resulting in more complex and entertaining play.

Another advantage of the present invention is to provide a novel method of playing a modified chess game having a modified playing field consisting of ten rows and ten columns, wherein the first and tenth rows each provide two dragon's lair squares. Such a ten-by-ten playing board results in a greater percentage of open area, and consequently a greater number of opening move sequences. The dragon lair squares provide an additional benefit of making possible a checkmate where one player has only a king and the other has only a king and two knights.

A still further advantage of the present invention is to provide a novel method of playing a modified chess game wherein a new piece, the dragon, results in the introduction of an entertaining and complex forking strategy.

DRAWINGS

These and other features, aspects, and advantages of the present invention will become better understood with regard to the following description, appended claims, and accompanying drawings where:

Figure 8:
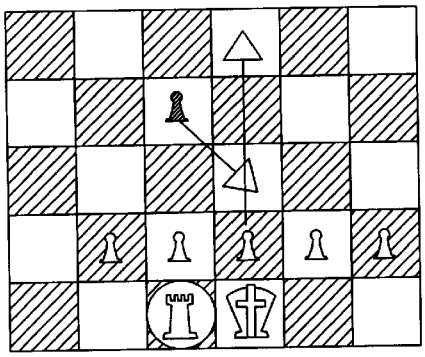

FIG. 8 is an example, showing a portion of the game board including portions of rows 1 through 5 and portions of columns 5 through 10, of a pawn moving three spaces on its first move, and also an example of the en passant move.

Figure 9:
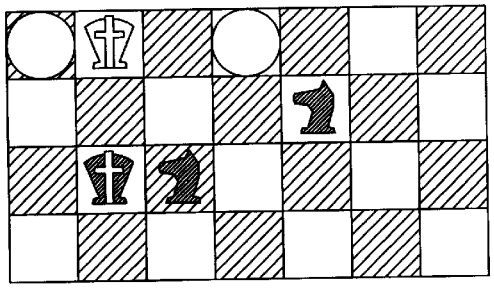

FIG. 9 is an example, showing a portion of the game board, illustrating the checkmate of the white king by the black king and two black knights.

Figure 10:
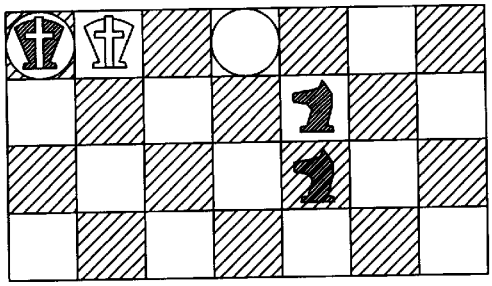

FIG. 10 is an example, showing a portion of the game board, illustrating the checkmate of the white king where the check is made by the black king from one of the black king's dragon's lair squares.

DESCRIPTION

Referring in generally to FIGS. 1 through 9, a method of playing a modified chess game in accordance with the rules of the invention is seen. The game board 20 provides alternating dark and light squares arrayed in a ten-row by ten-column configuration. The sixteen pieces of orthodox chess are all provided in each color, with the addition of ninth and tenth pawns and two new "dragon" pieces. Four dragon's lair squares are provided, two on each of the first and tenth rows. The dragon's lair squares provide a starting location for each dragon, and are located adjacent to starting position of the king and queen. A king may not move into the dragon's lair square of the opposing team; therefore a king caught between these squares may be checkmated by the opposing king with the assistance of two knights.

In general, the rules of orthodox chess apply to the instant invention, except as otherwise noted. The moves of orthodox chess are well-known, and are generally outlined in U.S. Pat. Nos. 5,735,523 and 5,690,334, which are hereby incorporated in their entirety by reference. Where a similar or alternative move is illustrated in the figures, the movement of the piece illustrated terminates in the space with the arrow head.

Figure 1:
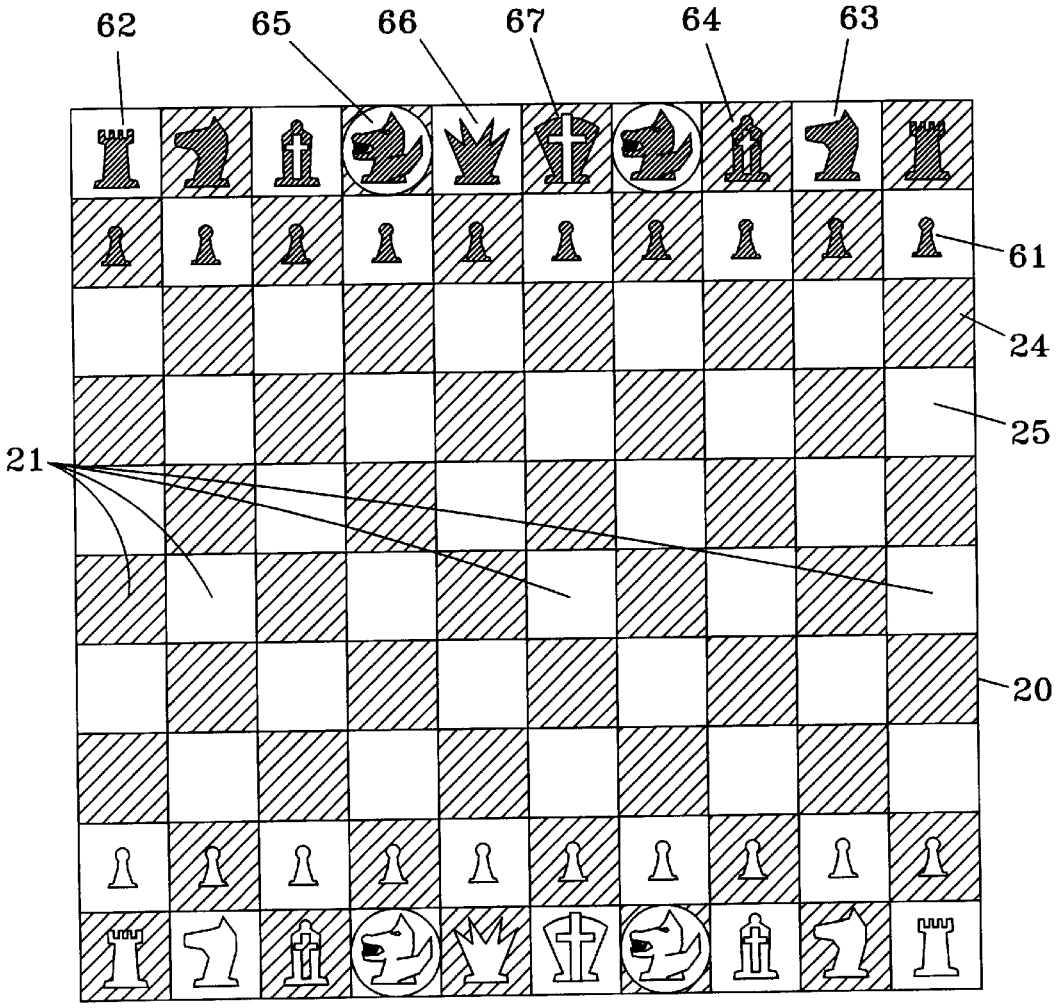
FIG. 1 is an isometric view of a version of the invention providing a ten row, ten column game board, wherein each player is provided initially with ten pawns, two rooks, two knights, two bishops, two dragons, a queen and a king.
Figure 2:
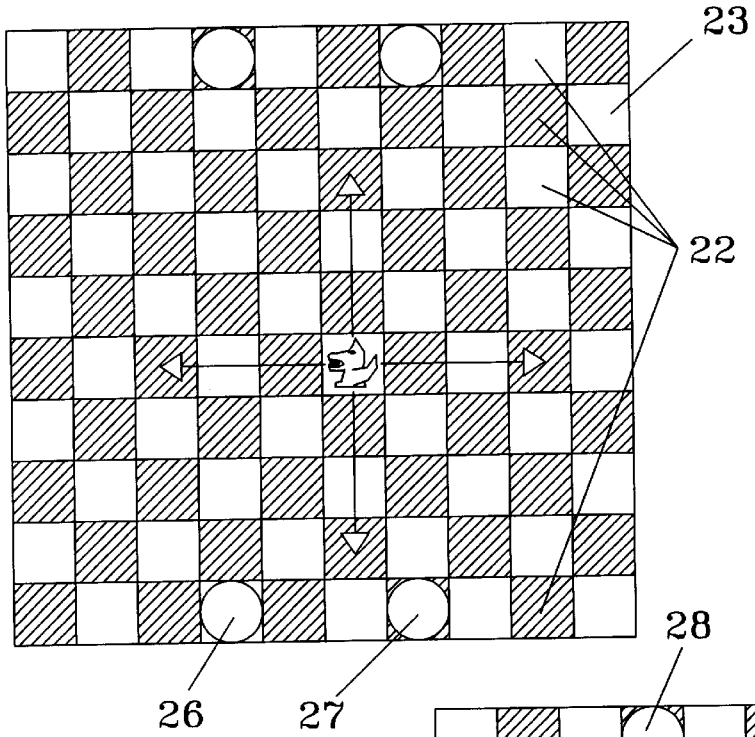
FIG. 2 is a view of the dragon piece moving three spaces in either vertical or either horizontal direction.

As seen in FIG. 1, a preferred version of the game board 20 includes a total of one hundred squares 23 of alternating light and dark color arrayed in ten rows 21 and ten columns 22, wherein each row and each column includes ten squares. As seen in FIGS. 1 and 2, a preferred game board includes a light colored square 25 in the lower right, as seen from each player's perspective. Alternatively, a dark colored square 24 may be used in this location.

Figure 3:
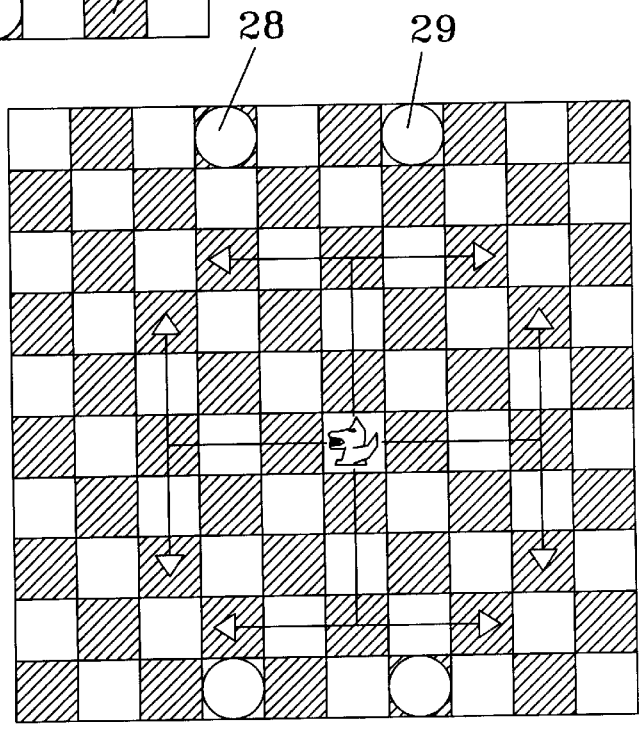
FIG. 3 is a view of the dragon piece moving three spaces in either horizontal direction and then two spaces in either vertical direction, or moving three spaces in either vertical direction and then two spaces in either horizontal direction.

As seen particularly in FIGS. 2 and 3, two dragon's lair squares are defined on the first and tenth rows of the game board. In particular, a first dragon's lair square 26 is defined in the first row in the fourth column; a second dragon's lair square 27 is defined in the first row in the seventh column; a third dragon's lair square 28 is defined in the tenth row in the fourth column; and a fourth dragon's lair square 29 is defined in the tenth row in the seventh column.

The dragon lair spaces may be indicated by any type of indicia, such as a circle or other marking, that will tend to make their existence obvious during the course of play.

It is a significant rule of the modified chess game of the invention that a king may not move onto the dragon's lair squares of the opposing side. For example, as seen in FIG. 1, the white king, initially starting in the first row at the bottom of the figure, may not move into the dragon's lair squares 28, 29 defined on the tenth row. Similarly, the black king, seen in row ten of FIG. 1, may not move into the dragon's lair squares 26, 27 defined in the first row.

It is a significant consequence of this rule that a king may be checkmated by an opposing king with only the assistance of two knights. This situation is seen in FIG. 9, where a portion of the board including parts of the seventh through tenth rows are illustrated. Here, the white king is under check by the black knight. Because the white king cannot move into the ninth row due to the location of the black king, and because the white king cannot move into the dragon's lair spaces 28, 29 because these squares were originally occupied by the black dragons, the check is both check and mate.

It is a further significant consequence of the dragon's lair spaces that a first king may move onto one of the first king's dragon's lair spaces when the second king is adjacent to that dragon's lair space, and thereby put the second king in check. This circumstance is seen in FIG. 10. This is in contrast to conventional chess, wherein it is never the case that one king may put another king in check, and wherein two kings may never be placed on adjacent squares.

As seen in FIG. 1, the black and white sides both include two rooks 62, two knights 63, two bishops 64 and one queen 66. These pieces move in the same manner allowed in orthodox chess, although due to the increased size of the board, the distance moved may sometimes be greater.

In a preferred embodiment of the invention, the king may castle to either side by moving either two or three spaces toward either rook. The rook toward which the king moved may then be moved to the side opposite the king from which it ordinally rested. In an alternative version of the invention, the king may move either one, two, three or four spaces toward the rook.

Figure 4A:
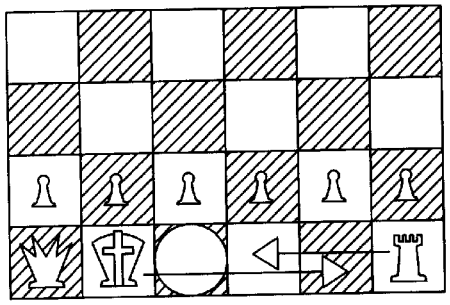
FIGS. 4A and 4B is an example, showing before and after views of a portion of the game board, of a king castling three moves to the right.
Figure 4B:
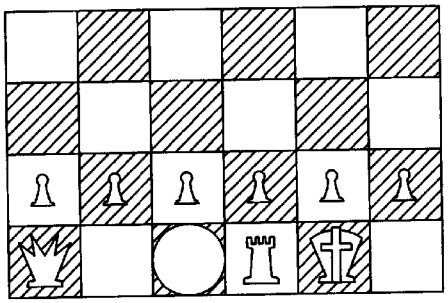
Figure 5A:
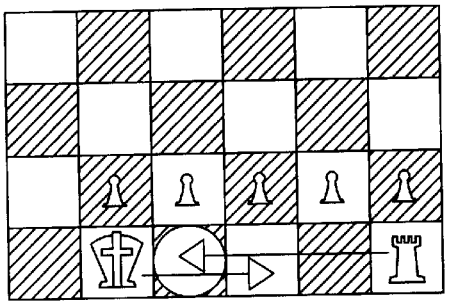
FIGS. 5A and 5B is an example, showing before and after views of a portion of the game board, of a king castling two moves to the right.
Figure 5B:
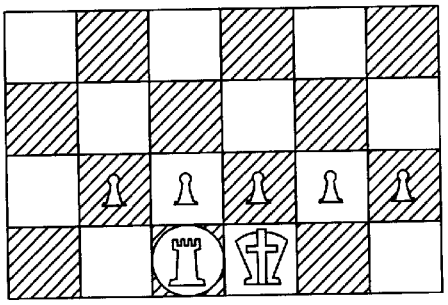
Figure 6A:
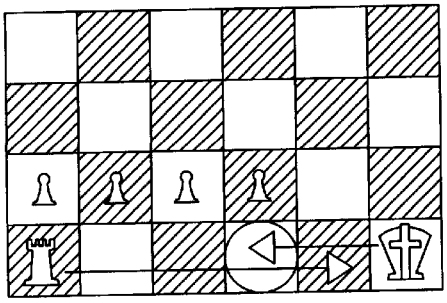
FIGS. 6A and 6B is an example, showing before and after views of a portion of the game board, of a king castling two moves to the left.
Figure 6B:
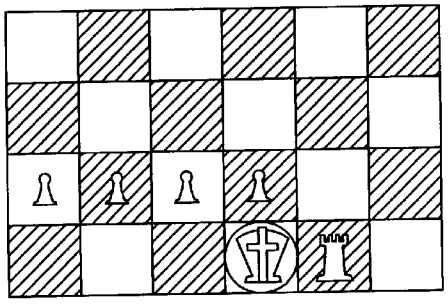
Figure 7A:
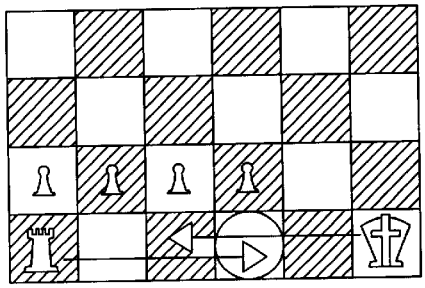
FIGS. 7A and 7B is an example, showing before and after views of a portion of the game board, of a king castling three moves to the left.
Figure 7B:
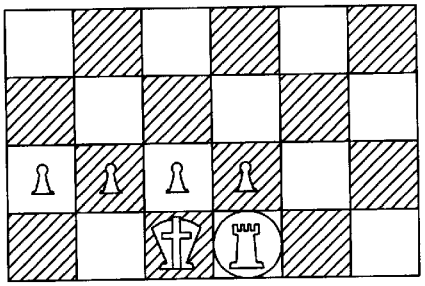

As seen in the before-and-after-move views of FIGS. 4A and 4B, the king may castle by moving three moves toward the right rook. The right rook is then moved to the left side of the king. As seen in the before-and-after-move views of FIGS. 5A and 5B, the king may castle by moving two moves toward the right rook. The right rook is then moved to the left side of the king. As seen in the before-and-after-move views of FIGS. 6A and 6B, the king may castle by moving two moves toward the left rook. The left rook is then moved to the right side of the king. As seen in the before-and-after-move views of FIGS. 7A and 7B, the king may castle by moving three moves toward the left rook. The left rook is then moved to the right side of the king.

As seen in FIG. 1, ten pawns 61 are provided for each color at the start of the game. The white side includes ten pawns, one pawn initially located on each square in the second row. The black side includes ten pawns, one pawn initially located on each square in the ninth row.

The pawns generally move in accord with the rules of orthodox chess, wherein each pawn has the option of moving one square forwardly or, when capturing an opposing piece, moving one square in the forward diagonal direction. However, where the pawn is in its original starting location, it may move either one, two or three squares forwardly. This is illustrated in FIG. 8, wherein a pawn is moved from the second row to the fifth row, while staying in the eighth column. This is in contrast to orthodox chess, where such a pawn may move only one or two squares forwardly.

Continuing to refer to FIG. 8, it can be seen that the en passant rule operates as in orthodox chess, but additionally includes the circumstance wherein a pawn initially moves three spaces forwardly. In the circumstance illustrated in FIG. 8, the white pawn has moved three spaces forwardly. One of the space through which it moved was one space diagonal of the black pawn. In the turn immediately following the white pawn's move, the black pawn may move diagonally into the space passed through by the white pawn, and then remove the white pawn from the board.

As seen in FIG. 1, a king 67 is provided for each color. The king moves generally in accordance with the rules of orthodox chess, i.e. one space in any direction that would not result in the king being in check. However, the king initially starting on the first row may not move onto the dragon spaces defined in the tenth row, and a king initially starting on the tenth row may not move onto the dragon spaces defined in the first row. As indicated above, this restriction on the king's movement may result in a checkmate in circumstance that in orthodox chess would result in a stalemate.

As seen in FIG. 1, each color is provided with two dragon pieces. To begin the game, the two dragon pieces line up, as seen, on either side of the king and queen in the dragon's lair squares.

The movement of each dragon may be understood from an examination of FIGS. 2 and 3, wherein the starting position of the dragon is indicated by the dragon icon, and the ending position of the dragon is the arrowhead. In all cases, the dragon may move over pieces in its path of movement. These pieces are not removed, but do not block the dragon's movement.

As seen in FIG. 2, the dragon may move to a square three squares in either horizontal or either vertical direction.

As seen in FIG. 3, the dragon may move to a square three squares in either horizontal direction and two squares in either vertical direction. The movement through the three horizontal squares and two vertical squares are all made in a single, jumping movement, wherein any pieces that may be in the pathway are jumped.

As is also seen in FIG. 3, the dragon may move to a square three squares in either vertical direction and two squares in either horizontal direction. The movement through the three vertical squares and two horizontal squares are all made in a single, jumping movement, wherein any pieces that may be in the pathway are jumped.

The previously described versions of the present invention have many advantages, including a primary advantage of providing a novel method of playing a modified chess game with a novel piece, the dragon, providing new and interesting moves, resulting in more complex and entertaining play.

Another advantage of the present invention is to provide a novel method of playing a modified chess game having a modified playing field consisting of ten rows and ten columns, wherein the first and tenth rows each provide two dragon's lair squares. Such a ten-by-ten playing board results in a greater percentage of open area, and consequently a greater number of opening move sequences. The dragon lair squares provide an additional benefit of making possible a checkmate where one player has only a king and the other has only a king and two knights.

A still further advantage of the present invention is to provide a novel method of playing a modified chess game wherein a new piece, the dragon, results in the introduction of an entertaining and complex forking strategy.

The invention resides not in any one of these features per se, but rather in the particular combination of all of them herein disclosed and claimed and it is distinguished from the prior art in this particular combination of all of its structures for the functions specified.

Although the present invention has been described in considerable detail and with reference to certain preferred versions, other versions are possible. For example, while in a preferred embodiment of the invention, the lower right corner of the board is white, it could alternatively be black. Similarly, while in a preferred version the king starts on his own color, in an alternative version of the invention the queen could start on her own color. And still further, while in a preferred version of the invention castling may result in the king moving either two or three squares toward the rook, in an alternate version of the invention the king may move between one and four squares, inclusive. Therefore, the spirit and scope of the appended claims should not be limited to the description of the preferred versions disclosed.

In compliance with the U.S. Patent Laws, the invention has been described in language more or less specific as to methodical features. The invention is not, however, limited to the specific features described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A method of playing a modified chess game by a first player against a second player, comprising the steps of:

(A) providing a game board consisting of ten horizontal rows and ten vertical columns of squares having alternating light and dark colors;

(B) defining four dragon's lair spaces, the dragon's lair spaces being located: in the first row in the fourth column; in the first row in the seventh column; in the tenth row in the fourth column; and in the tenth row in the seventh column;

(C) providing a plurality of playing pieces, including one set of light-colored pieces for the first player a second set of dark-colored pieces for the second player, each set of pieces comprising ten pawns, one king, one queen, two rooks, two bishops, two knights, and two dragons;

(D) initially positioning the set of light-colored pieces, at the start of the game, in the first row of ten squares at a first end of the game board from left to right in the sequence, rook, knight, bishop, dragon, queen, king, dragon, bishop, knight, and rook, with the light-colored pawns being initially positioned, one pawn in each square of the second row of ten squares;

(E) initially positioning the set of dark-colored pieces in the tenth row of ten squares at the opposing end of the game board, from left to right in the sequence rook, knight, bishop, dragon, queen, king, dragon, bishop, knight, rook, with the dark-colored pawns being initially positioned, one pawn in each square of the ninth row of ten squares;

(G) formatting rules of movement for play wherein each of the queens, the rooks, the bishops, the knights have the same rule of movement as the corresponding piece in orthodox chess;

(H) formatting rules of movement for play wherein each of the pawns have the same rules of movement as the pawns of orthodox chess, except that each pawn, on its first move, may move forwardly one, two or three squares;

(I) formatting rules of movement for play wherein each of the kings have the same rule of movement as the corresponding piece in orthodox chess, except that the king initially starting on the first row may not move onto the dragon spaces of the tenth row, and that the king initially starting on the tenth row may not move onto the dragon spaces of the first row, thereby making possible the checkmate of a first king by a second king and two knights of the second king's color;

(J) formatting rules of movement for play wherein each of the dragons may move to a square three squares in either horizontal or either vertical direction;

(K) formatting rules of movement for play wherein each of the dragons may move to a square three squares in either horizontal direction and two squares in either vertical direction; and (L) formatting rules of movement for play wherein each of the dragons may move to a square three squares in either vertical direction and two squares in either horizontal direction.

2. The method of playing a modified chess game of claim 1, further comprising:

(a) formatting rules of movement for play wherein each of the dragons may move over other pieces.

3. The method of playing a modified chess game of claim 1, further comprising:

(a) formatting rules of movement for play wherein a first king may put a second king in check when the first king is located on one of the first king's dragon's lair spaces.

* * * * *